US006500041B1

(12) United States Patent
Crome, Jr.

(10) Patent No.: US 6,500,041 B1
(45) Date of Patent: Dec. 31, 2002

(54) ANIMATED HEADSETS

(76) Inventor: Walter L. Crome, Jr., 70 Saratoga Dr., Lawrenceville, GA (US) 30044

( * ) Notice: Subject to any disclaimer, the term of this patent is extended or adjusted under 35 U.S.C. 154(b) by 0 days.

(21) Appl. No.: 09/695,200

(22) Filed: Oct. 24, 2000

Related U.S. Application Data

(60) Provisional application No. 60/161,263, filed on Oct. 25, 1999.

(51) Int. Cl.[7] ..... A63H 33/00

(52) U.S. Cl. ..... 446/27; 446/484; 446/485; 446/26; 2/209.13; 2/905; 2/195.1; 362/105

(58) Field of Search ..... 446/27, 26, 485, 446/484; 2/209.13, 195.1, 905; 362/105, 106, 107, 276

(56) References Cited

U.S. PATENT DOCUMENTS

| | | | | | |
|---|---|---|---|---|---|
| 3,901,505 | A | * | 8/1975 | Gerechter | 446/27 |
| 4,268,918 | A | * | 5/1981 | Lee | 446/27 |
| 4,488,372 | A | * | 12/1984 | Lowen | 446/27 |
| 4,658,446 | A | | 4/1987 | McGill | 2/209.1 |
| 5,329,637 | A | * | 7/1994 | Walker | 2/906 |
| 5,404,593 | A | * | 4/1995 | Kronenberger | 2/906 |
| 5,426,792 | A | * | 6/1995 | Murasko | 2/906 |
| 5,680,718 | A | * | 10/1997 | Ratcliffe et al. | 2/906 |
| 5,742,939 | A | * | 4/1998 | Williams | 2/908 |
| 5,781,934 | A | * | 7/1998 | Pauley, Jr. | 446/27 |
| 5,921,674 | A | * | 7/1999 | Koczi | 362/106 |
| 6,070,269 | A | * | 6/2000 | Tardif et al. | 2/912 |
| 6,223,355 | B1 | * | 5/2001 | Irving | 2/171 |

FOREIGN PATENT DOCUMENTS

DE 29610036 U1 * 10/1996 ..... A42B/01/04

* cited by examiner

*Primary Examiner*—Derris H. Banks
*Assistant Examiner*—Urszula M Cegielnik
(74) *Attorney, Agent, or Firm*—Bernstein & Assoc, P.C.; Jason A. Bernstein

(57) ABSTRACT

An animated head gear assembly that features an object that simulates an animal, fowl, caricature, inanimate object, and the like, to be worn on the head of a user. The object offers motion, such as the moving parts of a bird's beak, and a light to simulate the eyes or other item of the object. The animation may be activated by a remote source, such as a remote control, or by a motion sensor that frees the hands of the wearer.

2 Claims, 8 Drawing Sheets

ANIMATED HEADSETS

CROSS REFERENCE TO RELATED APPLICATION

This application claims benefit of copending provisional patent application Ser. No. 60/161,263, filed Oct. 25, 1999, the disclosure of which is incorporated herein in its entirety.

FIELD OF THE INVENTION

This invention is directed to the field of animated head gear having simulated objects, such as a variety of animals, that may be remotely activated by the wearer thereof to effect movement of the object.

BACKGROUND OF THE INVENTION

The present invention relates to a unique type of head gear that includes remote means for the wearer thereof to effect movement of elements of the headgear. The prior art is replete with various types of static head gear that one may wear to tout a favorite sports team, for example. One such well known head gear is the "cheese head" worn by fans of the Green Bay Packers, where the head gear is a simulated slab of cheese having a recess for placing on the wearer's head. There are others where the head gear is a helmet like device that may include items indicative of the team one is promoting. However, these are all static devices that remain motionless when worn. To add to the spirit of the event, whether it be a sporting event, party, or at Halloween, it may be desirable to add a new dimension to the event by providing animation to the wearer's outfit.

U.S. Pat. No. 4,658,446, to McGill, illustrates an example where a head covering, in the form of a hat or cap, offers some animation in the form of a pair of flappable members, such as clapping hands. The hands are moved by a string connected thereto and operated by the wearer. Another prior art example is found in U.S. Pat. No. 4,488,372, to Lowen. The patent teaches a head mounted motor driven system where the motor operates a vertical rod mounting ornaments that rotate at a slow 1 speed. Neither of such patents teach an animated head gear system that incorporates a simulation of an object, such as an animal, that reveals motion and light at the same time.

The present invention provides the animation and light by a remote means discretely held by the wearer to effect movement and light in the animated head gear hereof. The manner by which this unique arrangement is achieved for the animated head gear of this invention will become apparent in the description which follows, particularly when read in conjunction with the attached drawings, where such drawings illustrate a variety of embodiments for the head gear.

SUMMARY OF THE INVENTION

The present invention is generally directed to a unique head gear that offers animated features to the simulated object or character illustrated on the head gear, where such simulated object may be an animal, a historic figure, a caricature from popular novels, sports figures, objects associated with a sports team, vehicles, or a host of other objects familiar to all.

While the selected or designated object may take a variety of forms, a preferred form is that of an animal head where one may wish to effect movement in the mouth, limbs, wings, ears, and the like, or illumination of the eyes of the animal, or a combination of both. A preferred form may be that of a bird having a movable beak, and a pair of eyes that can be illuminated. Irrespective of the form, the head gear hereof includes a seat or frame upon which is mounted a platform, preferably planar, having a battery powered motor to operate the beak, i.e., ,open and close, as the wearer may choose, where the motor rotates an eccentric arm connected to the upper beak, for example. Positioned forward of the motor is an elevated support for mounting an eye reflector plate and light bulb to underlie the bird's eye location, i.e., above the beak. Covering the platform, motor and eye reflector plate and light is a shroud, with eye openings, colored and designed to simulate the head of the bird, or other selected object. To effect movement of the beak, and to light the eyes, a hand held remote control, electrically connected to the motor and light bulb, may be positioned in the pocket of the wearer whereby to give the impression that such movement or light is automatic. Finally, means, such as in the form of a strap, may be secured to the seat or frame, to underlie the wearer's chin to hold the head gear in place. Optionally, the system may include a motion sensor to activate the animated features, thus freeing the wearer of remotely controlling such features. This would free the wearer to use his/her hands for other purposes.

Accordingly, an object of the invention is to provide an attention- getting, animated head gear that is remotely operated by the wearer thereof to effect movement and lighting of the animated features.

Another object thereof is the provision of incorporating the animated features into a simulated object, such as an animal's head, or other common mascot characters particularly associated with sports teams.

These and other objects of the invention will become more apparent from the specification which follows, particularly when read by those skilled in the art.

DETAILED DESCRIPTION OF PREFERRED EMBODIMENTS

Figure 1:
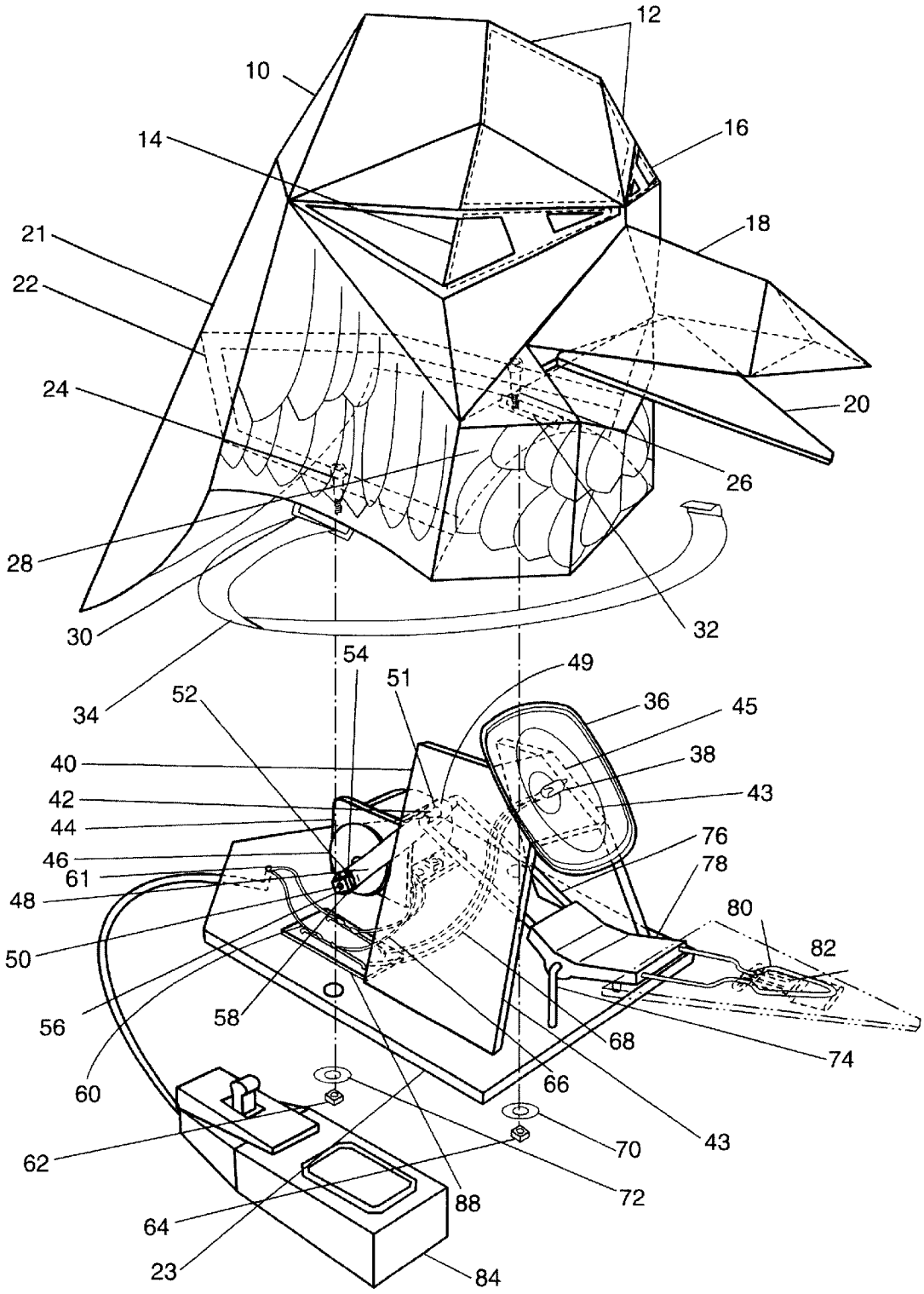
FIG. 1 is an exploded perspective view, with some components shown in dotted lines to reveal details thereof, of a preferred form for the animated head gear of this invention.

The present invention is directed to a unique style head gear having light and motion animation features, where the head gear further features an object of a variety of subjects simulating animals, or other popular objects of common interest. The invention will now be described with regard to the accompanying Figures, where like reference numerals represent like components or features throughout the several views.

Figure 2:
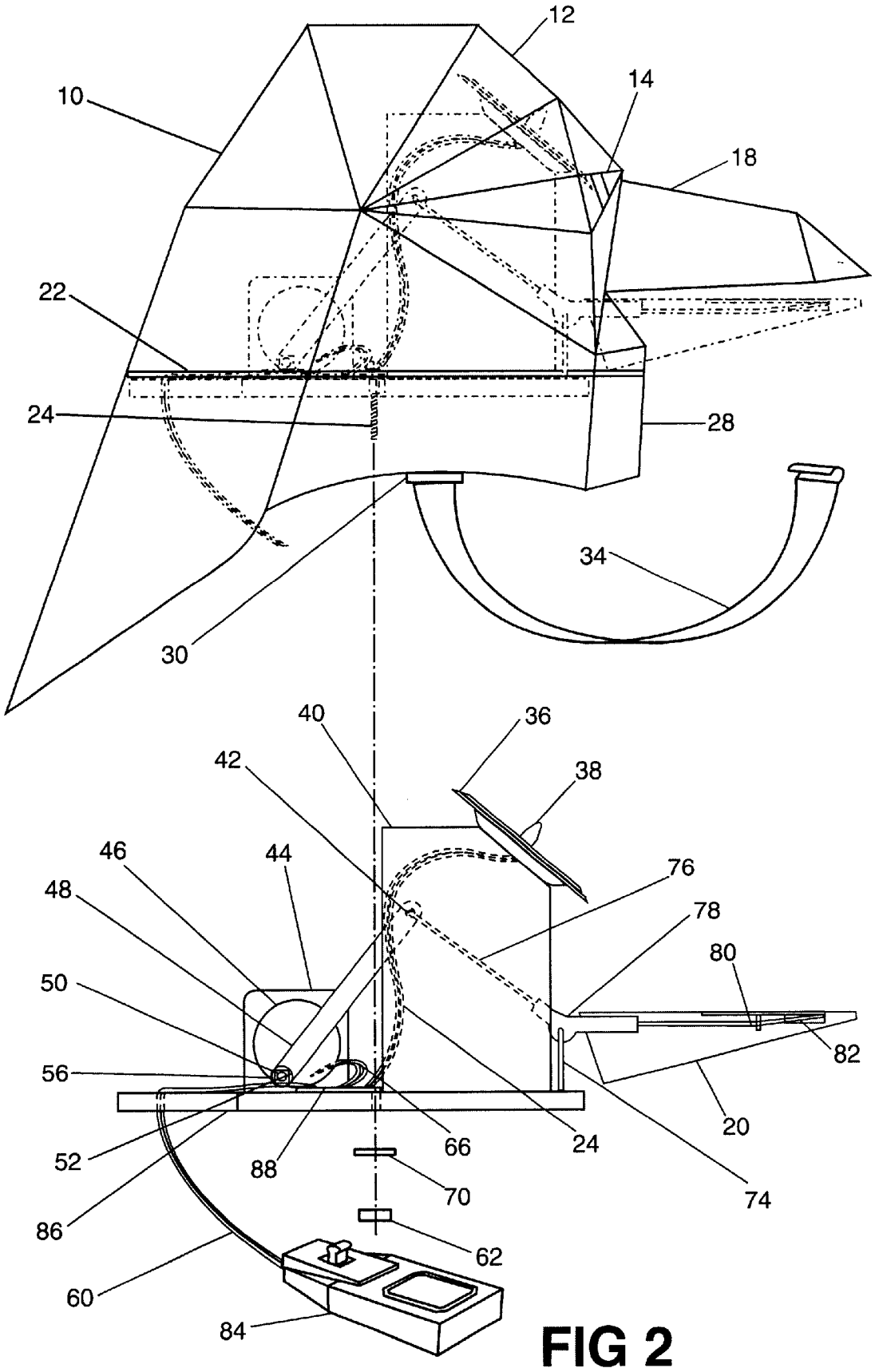
FIG. 2 is an exploded side view, with certain hidden components shown in dotted line, of the preferred embodiment of FIG. 1.
Figure 3:
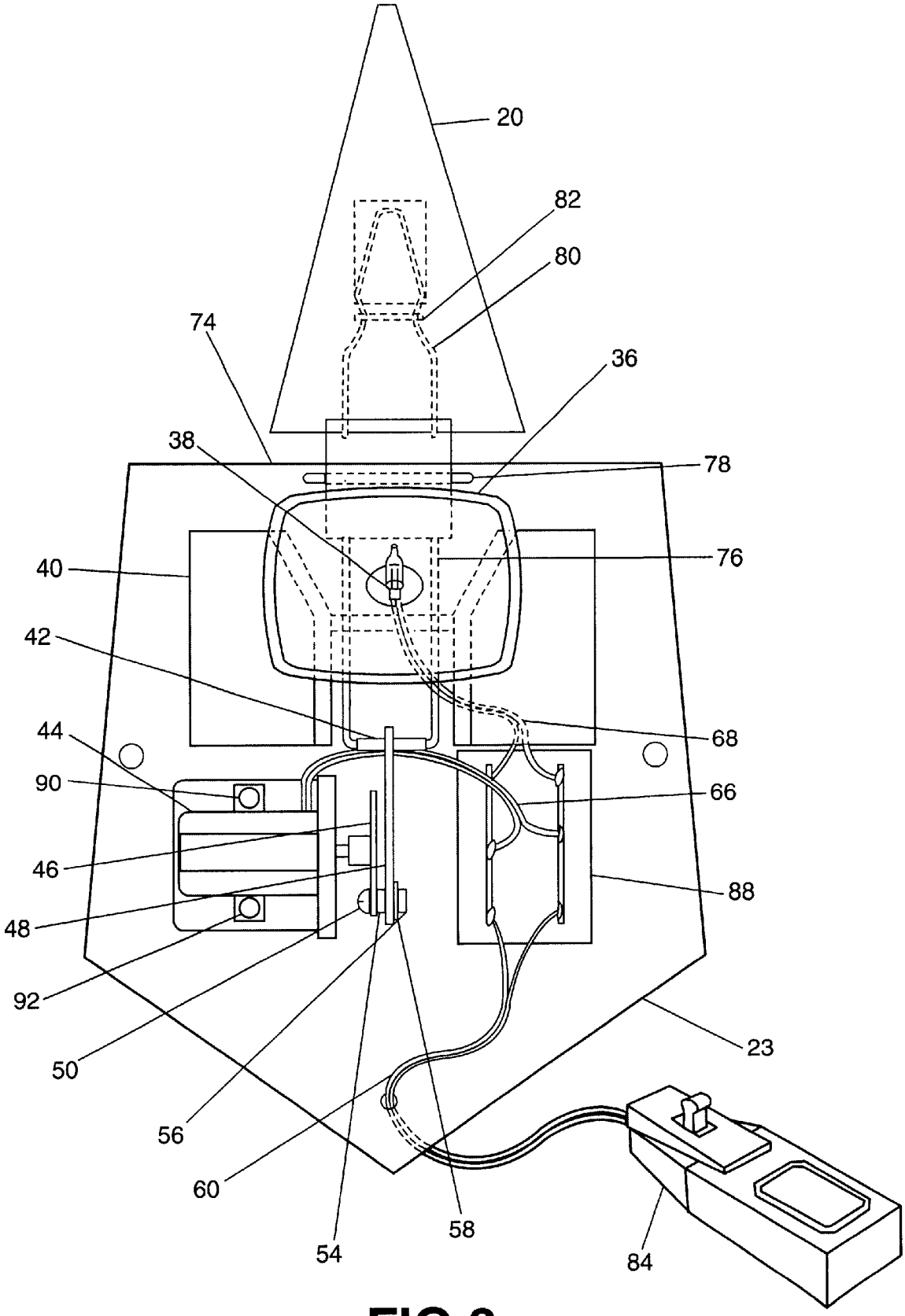
FIG. 3 is a top view of the light and animation features of the animation mechanism for the animated head gear of the invention.

Turning now to the Figures, FIGS. 1–3 illustrate the operating mechanism for the animated features of the head gear of the present invention. The invention comprises a headpiece 10, such as made of plastic and may include one or more head reflector plates 12. Additionally, the headpiece preferably includes a pair of openings, covered by a film of transparent or translucent eye plates 14, 16, a fixed 2 upper beak 18, such as in the preferred form of a bird, and a lower movable beak 20. Connecting such components and providing shape to the headpiece 10 is a shroud 21 that may be colored and designed with features which simulate the selected object, i.e., features and the like.

Internally, the assembly hereof comprises a platform seat 22 permanently fixed to said shroud 21 for mounting a platform 23, preferably planar in shape, by a pair of screws 24 and associated washer and nut, and for fastening a strap as later explained. To conveniently seat upon the wearer's head, the assembly may also include a shaped neck plate 28 that is concave to more easily seat on the wearer's head. The platform 23, as best seen in FIG. 1, mounts an electric motor 44, see FIG. 3, and a rotating wheel 46 including a piston or eccentric arm 48, where the arm is pivotally mounted to the wheel 46 by a screw, nut and washer, as known in the art. The free end 49 of the arm 48 includes an opening 51 for receiving a pivotal beak shaft 76. The beak shaft, at its 1 opposite end, is secured to a pivot or rocker member 78 that pivots about pivot holder 74 fixed to platform 23. Extending from the opposite end of the pivot or rocker member 78 is beak shaft clip 80 for securing to the lower beak 20. Accordingly, as the motor rotates, the arm 48 moves up and down to pivot the pivot or rocker member 78, which in turn causes the lower beak 20 to move relative to the upper beak 18. Overriding the beak shaft 76, and forward of the motor 42, is a harness support 40 consisting of a pair of vertically angled walls 43, where the upper ends have further angled portions 45, see FIG. 2. On the respective angled portions is mounted a light reflector plate 36 positioned to underlie the eye plates 14, 16. Additionally, centrally mounted of the light reflector plate is a light bulb 38, where light from the bulb is reflected and magnified by the light reflector plate. Electrically connecting said light bulb 38 to a power source are the wires 68 extending to the circuit plate 88. Further, wires 66 extend therefrom to the motor 44. From the circuit plate 88 an electrical connection is made via a cord 60 through platform opening 61 to a remote control device 84, as known in the art, where the electrical power source, such as batteries, is included, see also FIG. 6. Finally, an elastic strap 34 may be provided to secure the assembly hereof to the head of a wearer.

Figure 4:
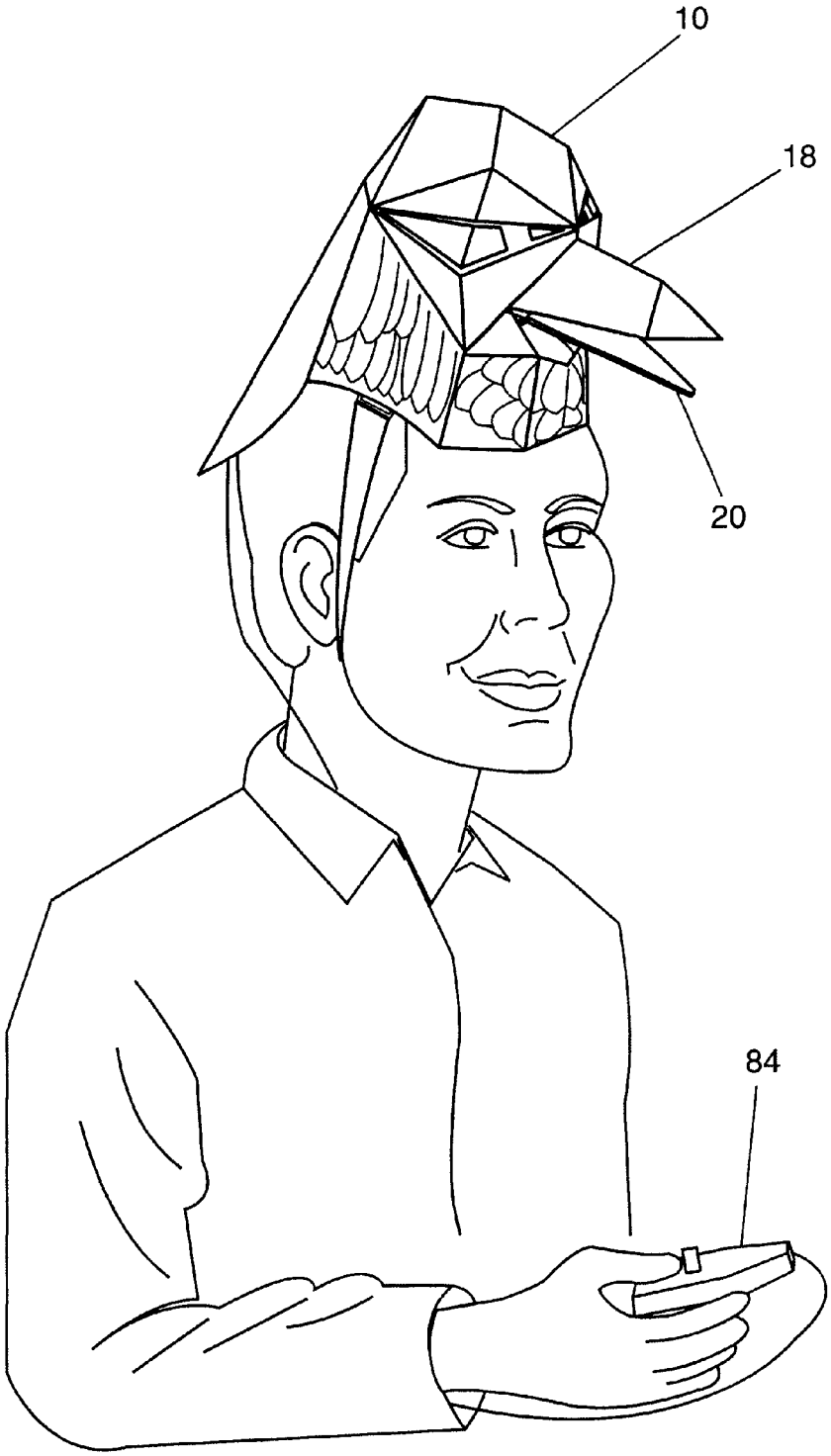
FIG. 4 is a perspective view of a person wearing the animated 2 head gear of FIGS. 1 and 2, where the person is holding the remote control for operating the animation features.

FIG. 4 is a perspective view illustrating how the assembly of this invention may appear on the head of a wearer thereof, where the strap 34 is shown as being under his chin, and the remote control device 84 in his hand.

Figure 5:
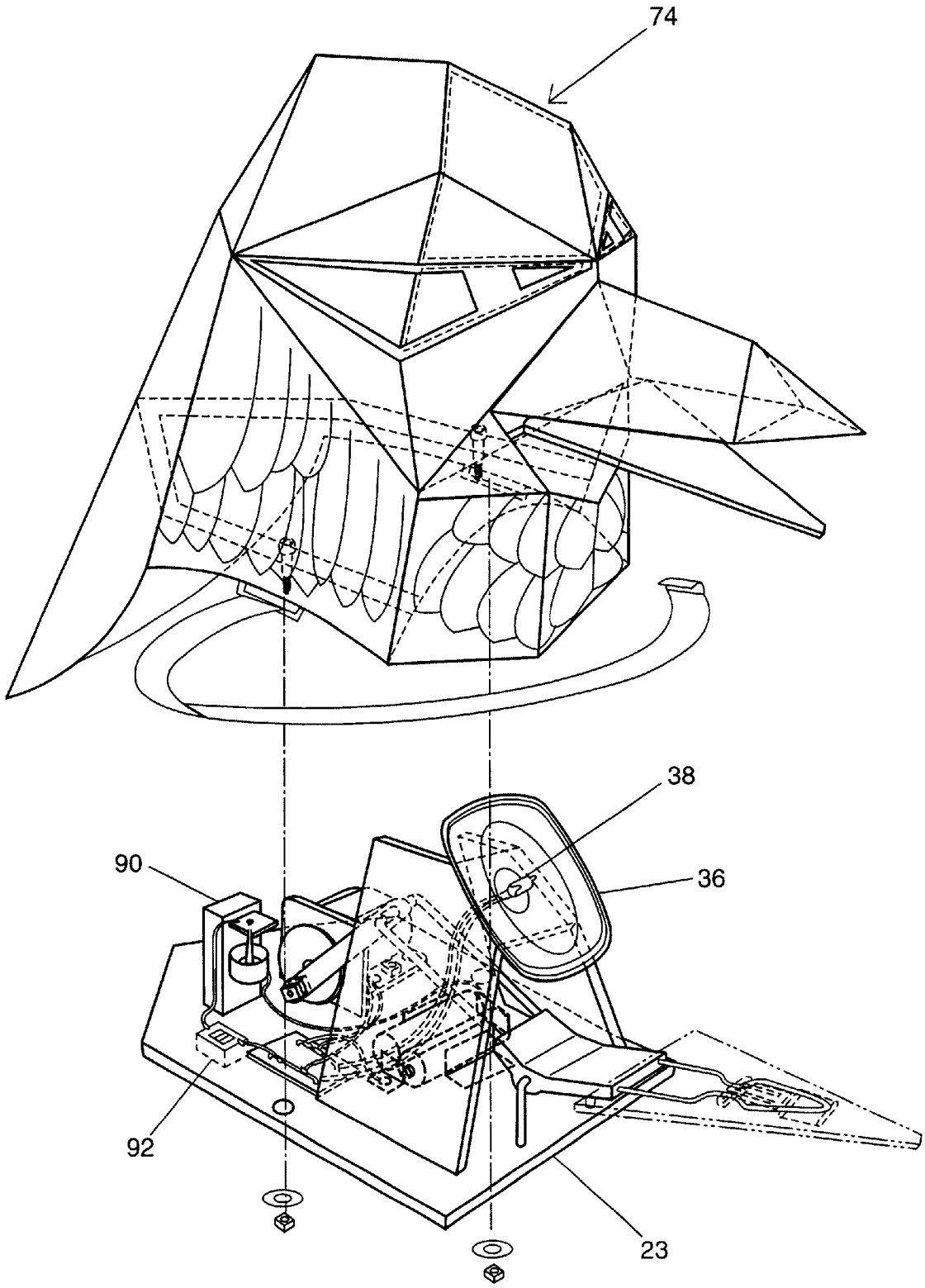
FIG. 5 is an exploded perspective view of the preferred assembly of FIGS. 1 and 2, further showing the addition of a motion sensor device.
Figure 6:
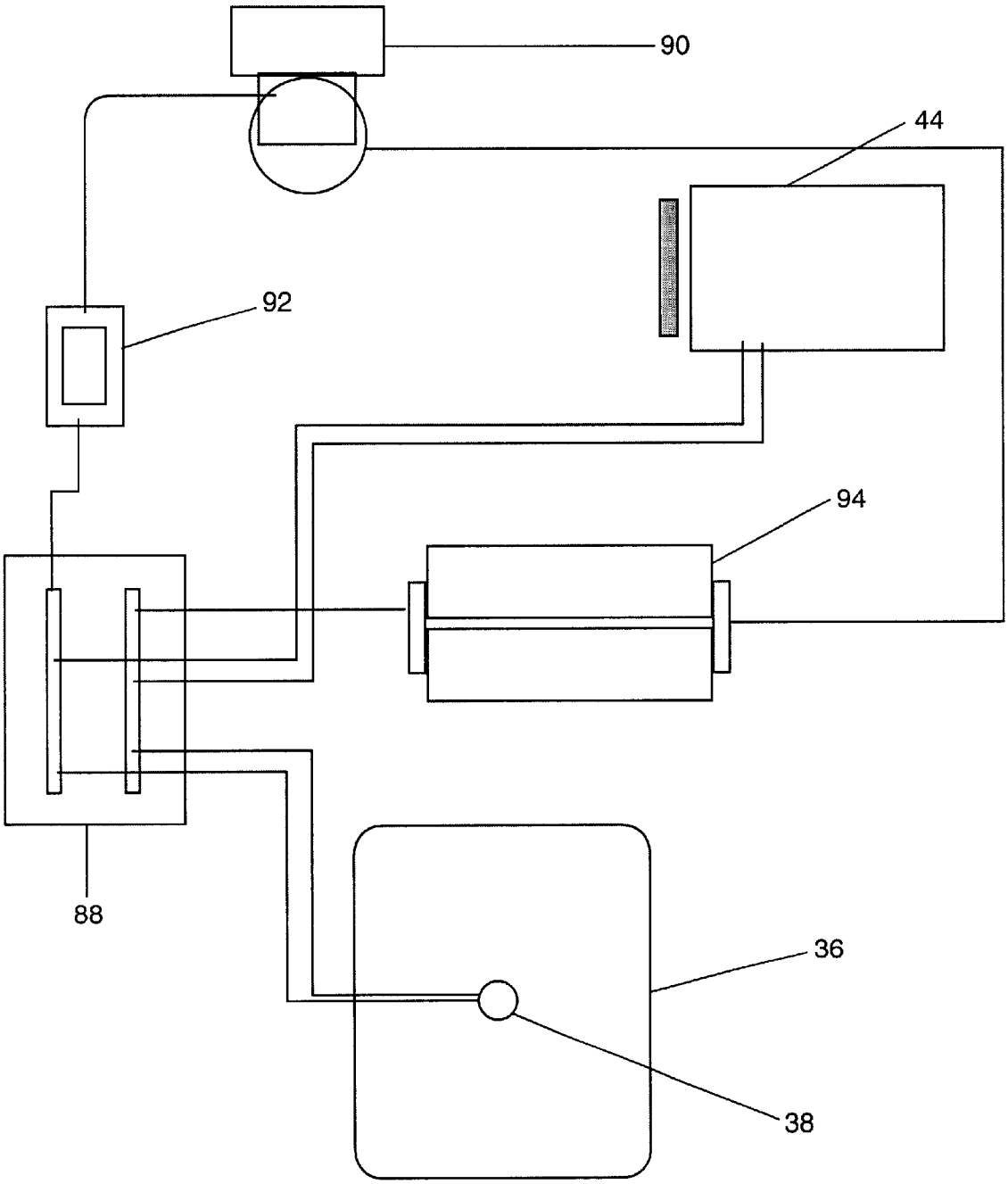
FIG. 6 is a simplified schematic of the electrical power system for the motion sensor embodiment of FIG. 5.

Turning now to FIGS. 5 and 6, an optional feature is illustrated to enhance the unique features of the assembly. There are times when it may not be appropriate to handle the remote control, such as when one's hands are occupied, but one still desires to animate the assembly, where such animation will be a particularly fascination for those passing by. The modified or hands-off assembly may include a motion sensor 90 that can be energized by an ON/OFF switch 92, where the switch is conveniently mounted on the underside of the platform 23 for accessing by the wearer. In the ON position, the motion sensor 90, as known in the art, replaces or supplements the remote control device as the means for operating the system. FIG. 6 shows a simplified schematic of the electrical system incorporating the motion sensor 90 and switch 92. In the event the wearer wants a fully automatic operating system, that is, no remote control device, the motion sensor may be the exclusive means for operating the assembly, where the batteries 94 may be positioned on the platform 23, see FIG. 5.

Figure 7:
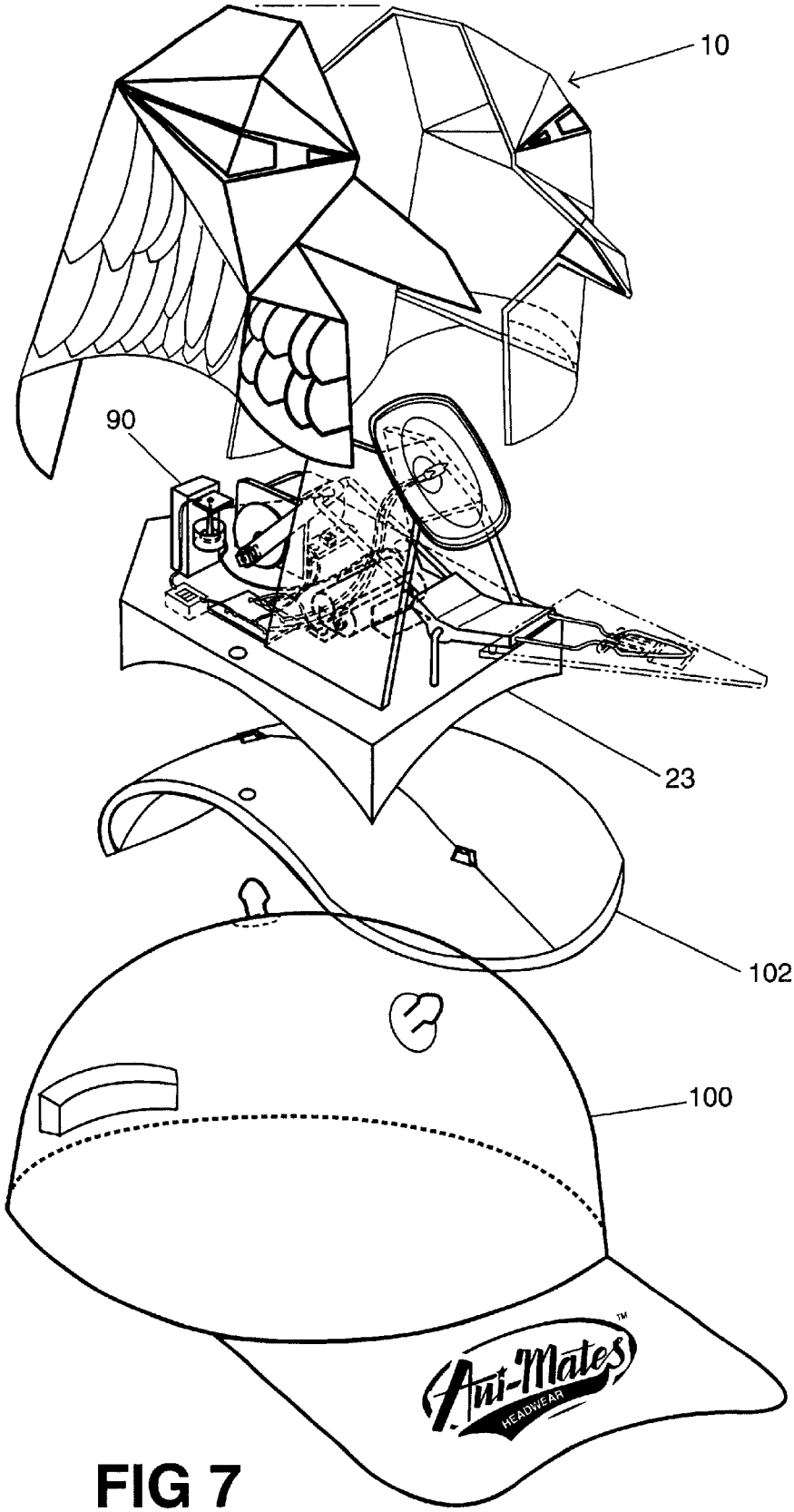
FIG. 7 is an exploded perspective view of the assembly on this invention, showing further an alternate mounting system for mounting the assembly to a conventional plastic cap.

The preferred embodiment of FIGS. 1–3 shows the assembly as an integral unit that is strapped to the wearer's head by a chin strap. However, it is contemplated, as illustrated in FIG. 7, to mount and secure the platform 23', modified by exhibiting a lower concave surface, directly to a conventional plastic cap 100, as known in the art. To accommodate, or take advantage of platform contours that may be slightly different from the convex shape of the cap, an intermediate member 102, such as a sponge, may be placed between the platform 23' and the cap 100.

Figure 8A:
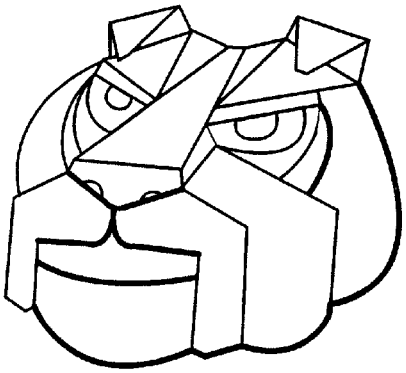
FIGS. 8A through 8F are perspective views of a variety of simulated objects or animals that may used in the assembly of this invention.
Figure 8B:
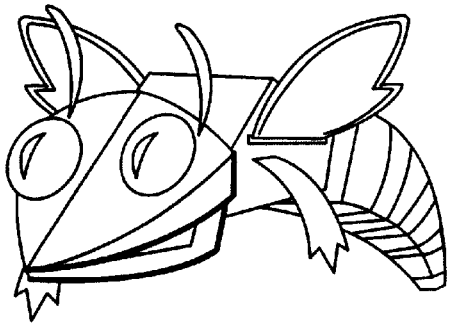
Figure 8C:
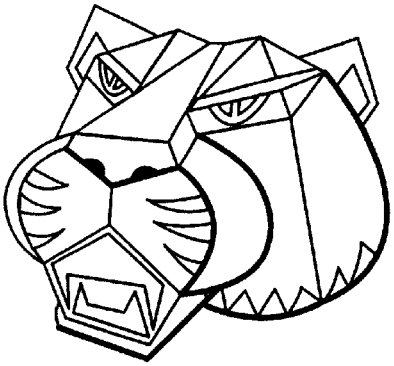
Figure 8D:
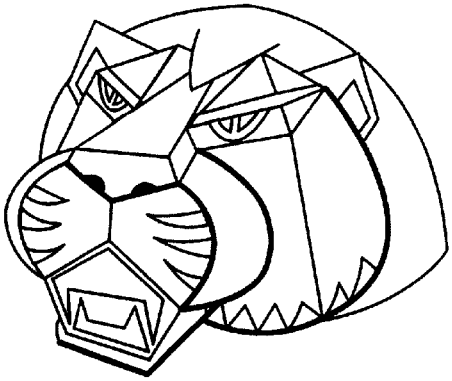
Figure 8E:
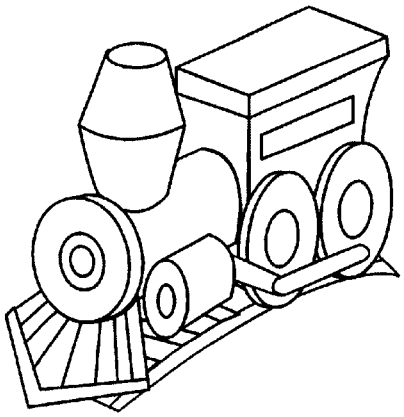
Figure 8F:
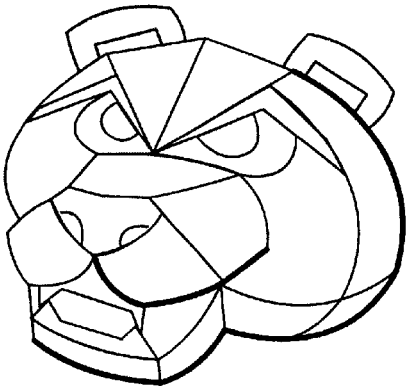

While a preferred embodiment was illustrated and discussed above, 1 it is contemplated that the simulated object may have a variety of shapes and designs. FIGS. 8A through 8F illustrate just a few of the simulated objects covered by this invention. Such objects may be selected from the group consisting of animals, fowl, caricature figures, inanimate objects, and the like. While the most common selection of objects may be animals and fowl, FIG. 8B shows a bumble bee, while FIG. 8E shows a train engine.

The present invention will provide any sports fan, sports industry, or any business which may be represented by a mascot or any other logo, with an animated version of their emblem or trademark. The invention is lightweight, easy to operate (remote control, new "theory of operation", spring operated elements and movable and removable elements), inexpensive and can be used by persons of almost any age. In addition to being battery operated, it is also conceivable that "solar" energy can be used for power. The invention can be "one size fits all" or it can fit different size caps (store bought or special attachable cap). While the description of the invention contains many specifics, these should not considered to be limitations of the scope of the invention, but rather exemplify the preferred embodiment. Many variations are possible.

The reason the preferred embodiment is the most logical is because operating the invention is a technique that is familiar with anyone who wears it. All you have to do is to push a button or lever and it operates. By hiding the remote wire in the sleeve of the wearer, it appears that the invention is operating on its own. All elements of this embodiment can be changed in size if needed. The ideal material for the exterior of this embodiment is plastic, however it is conceivable that other materials could be used. The interiors ideal material is also mostly plastic, but other material could also be substituted if needed. The exterior of the prototypes (preferred and alternative embodiment A) were built with dense cardboard and plastic. The interior can be constructed with plastic, metal, foamboard and many other miscellaneous materials. The shape of the exterior can vary and is mostly open to artistic interpretation. The color of the invention can and will vary. Color variations are discussed later. Discussion of the alternative embodiments will explain this inventions different methods of operation and its capacity to utilize these methods in many different ways. Further discussion will also show just how potentially broad the uses for this invention are and how this invention can be connected with its surrounding elements in different ways. It will also show how it can be given different modes and different functions of operation and how this invention can be made in modular forms and in sections. This embodiment, along with all the embodiments that are battery operated, can also have sound added to them using commercially available components and integrated by mechanisms known to those skilled in the art.

Alternative embodiment A probably has more potential as a desktop model rather than a model to be worn on the head like the other embodiments. This embodiment is attractive because it has more birdlike features than the preferred embodiment. This embodiments prototype was constructed of the same materials as the preferred embodiments prototype. The flexibility of this embodiment allows the invention to be changed in size, shape and color. Even though this embodiment, as stated before, will work well as a desktop model, it is conceivable that it could be worn on the head. This would make it features compatible with the features of the other alternative embodiments; motion sensor, attachable to special cap, spring operated elements etc. Even if not worn on the head, these features could still be utilized.

Alternative embodiment B is operated by motion sensor (theory of operation) rather than remote control. This design offers all the advantages of the preferred embodiment. Its elements are also very flexible in size, shape, material and color. Like the preferred embodiment, it also can be attached to the head in different ways; using the chin strap (FIGS. 1-F & 1-G), or the special attachable cap (FIG. 2-I) as follows.

Alternative embodiment C's main feature is that it allows alternative embodiment B (or the preferred embodiment) to be attached to a special made cap (FIG. 2-I). This cap enables other additional embodiments to be switched back and forth, to and from the special cap. This embodiment is also very flexible in size, shape, material and color.

Alternative embodiment D offers all the same advantages as the preferred embodiment with the exception that it has no motorized features. Instead of using motorized elements, spring elements can be used. For example, the lower beak on the preferred embodiment will use springs to allow the beak to move up and down instead of it being motorized. This designs elements are also very flexible in size, shape, material and color. Like the preferred embodiment, it also can be attached to the head in different ways; using the chin strap or the special attachable cap.

The most inexpensive and probably the simplest of the alternative embodiments is alternative embodiment E. This embodiment will be animated in the sense that it can be removed and replaced by another design (additional embodiments). In essence, all the embodiments can be removed and replace by another, however, this is this embodiments only unique animated feature. The other embodiments are animated and can function using either motorized or spring operated features. This designs elements are also very flexible in size, shape, material and color. The primary method of attaching this embodiment to ones head is the attachable cap.

The scope of this invention has many potential uses. The reader of this application will see that this invention will provide any sports fan, sports industry, or any business which may be represented by a mascot or any other logo, with an animated version of their emblem or trademark. Many variations are possible. This invention was created mostly for the sports industry, however, is not limited to it. Not only will every sports fan, or any entity mentioned above, be able to purchase an animated headset version of their favorite mascot or stock car driver, but any business will be able to promote their business using an animated headset.

In some cases, some sports teams, as with some businesses, will have the same product name or mascot. Such as "Panthers" or "Bulls". What will ensure each team or business that their identity will be maintained will not be the difference in the patent, but the difference in the markings (color and design) of each one. For example, The Georgia Bulldogs may use Red and Black as their dominant team colors. While the Mississippi State Bulldogs may use a combination of red and blue. The protection of the color and the design will come under copyright and trademark protection. This will not affect the patent. One way to think of this is Stock Car Racing. Even though each car operates under the same principles and guidelines, each car looks different because of the type of car it is (Chevy Monte Carlo or Ford Thunderbird Stock Cars, Indy and Grand Prix race cars), and the colors/designs selected for corporate identity. The same ideals exists here.

This invention has many more "exotic" uses. Not only can it be utilized in the business and sports arena, it can also be used in some existing applications. For example, existing Star Wars figures can be converted into an "animated headset," "Luke Skywalker" or a "Darth Vader" design. The same applies to "Star Trek" figures, the "Chevron" promotional cars and can even be applied to the "wrestling" arena. Instead of having a "War Veteran" headset, a headset for "Hulk Hogan", "Sting" or "The Rock" can be used. Lets not forget "Disney" figures, such as "Mickey Mouse", "Donald Duck" or even more recently "The Lion King". Comic book characters such as "Spider Man", "The Incredible Hulk" or "Batman" are also great possibilities. Just about any marketable novelty item or character can be converted to an "animated headset".

While it is contemplated that variations, changes and modifications may be made to the assembly of this invention, particularly in the selection of the simulated object, especially by those skilled in the art, no limitation is intended to be imposed thereon except as set forth in the accompanying claims. All patents, publications and other documents referred to herein are incorporated by reference in their entirety.

I claim:

1. An animated head gear assembly comprising an opaque cover simulating an object selected from the group consisting of animals, fowl, caricature figures and inanimate objects, where the cover includes at least one opening, with the opening being covered by a light transmitting member, and a first cover member movable relative to a second cover member, and a platform under said cover for securing to the wearer's head, said platform mounting a motor operating an eccentric wheel operable to move said first cover member from a first position adjacent said second cover member to a second position spaced therefrom, and a light reflector plate mounting an electric light bulb, where said light reflector plate is positioned in close proximity to said at least one opening, an electric power source in electrical communication with said motor and said light bulb, and means for the selected operation of said motor and said light bulb.

2. The animated head gear assembly according to claim 1, wherein said operation means is a manually operated remote control device.

* * * * *